US005375048A

United States Patent [19]

Barnes

[11] Patent Number: 5,375,048

[45] Date of Patent: Dec. 20, 1994

[54] COLLAPSIBLE LAMPSHADES

[76] Inventor: Charles F. Barnes, 29 Melbourne Road, Chichester, West Sussex, PO19 4nd, Great Britain

[21] Appl. No.: 30,139

[22] PCT Filed: Sep. 3, 1991

[86] PCT No.: PCT/GB91/01485

§ 371 Date: Apr. 27, 1993

§ 102(e) Date: Apr. 27, 1993

[87] PCT Pub. No.: WO92/04578

PCT Pub. Date: Mar. 19, 1992

[30] Foreign Application Priority Data

Sep. 3, 1990 [GB] United Kingdom ..... 9019203

[51] Int. Cl.[5] ..... F21V 1/06

[52] U.S. Cl. ..... 362/352; 362/358; 362/434; 362/450

[58] Field of Search ..... 362/351, 352, 358, 287, 362/410, 427, 434, 441, 442, 449, 450; 248/150, 165

[56] References Cited

U.S. PATENT DOCUMENTS

| | | | |
|---|---|---|---|
| 661,036 | 11/1900 | Clark | 248/165 |
| 856,190 | 6/1907 | Baumer | 362/358 |
| 1,173,665 | 2/1916 | Jakab | 248/165 |
| 1,381,796 | 6/1921 | Casswell | 362/434 |
| 1,452,773 | 4/1923 | Amores | 362/450 |
| 4,290,099 | 9/1981 | Vicars-Harris | 362/352 |
| 5,058,839 | 10/1991 | Stevens | 248/150 |

FOREIGN PATENT DOCUMENTS

| | | | |
|---|---|---|---|
| 494570 | 7/1950 | Belgium . | |
| 600001 | 10/1925 | France | 362/352 |
| 3227737 | 1/1984 | Germany . | |
| 16315 | 6/1900 | United Kingdom | 362/358 |
| 16839 | 8/1910 | United Kingdom . | |
| 167546 | 8/1921 | United Kingdom | 362/358 |
| 2052037 | 1/1981 | United Kingdom . | |

*Primary Examiner*—Ira S. Lazarus
*Assistant Examiner*—Y. Quach
*Attorney, Agent, or Firm*—Thomas P. Liniak

[57] ABSTRACT

A frame (2) for a collapsible lampshade comprising: upper (4) and lower (6) support members spaced in parallel planes; a plurality of peripherally spaced rib members (8) extending between the support members (4 and 6), each rib member (8) being pivotally mounted at one end (10) to the upper support member (4) and at the other end (12) to the lower support member (6) and having a hinge located intermediate said ends, and a spider member (14) having a central hub (16), and a plurality of radially extending struts (18), each strut (18) being affixed at one end to the hub (16), the other end (20) being pivotally attached to a slide (22) mounted on one of the rib members (8).

The spider member (14) is movable in a direction substantially perpendicular to the support members (4 and 6), which movement renders the frame (2) from a braced condition, in which movement of each rib member (8) about its respective hinge is prevented, to a collapsible condition, in which each rib member (8) is free to pivot, either inwardly or outwardly about its respective hinge to draw the two support members (4 and 6) together to collapse the frame (2). By reversing this movement, the two support members (4 and 6) are drawn apart, thereby erecting the frame (2).

12 Claims, 2 Drawing Sheets

COLLAPSIBLE LAMPSHADES

Figure 1:
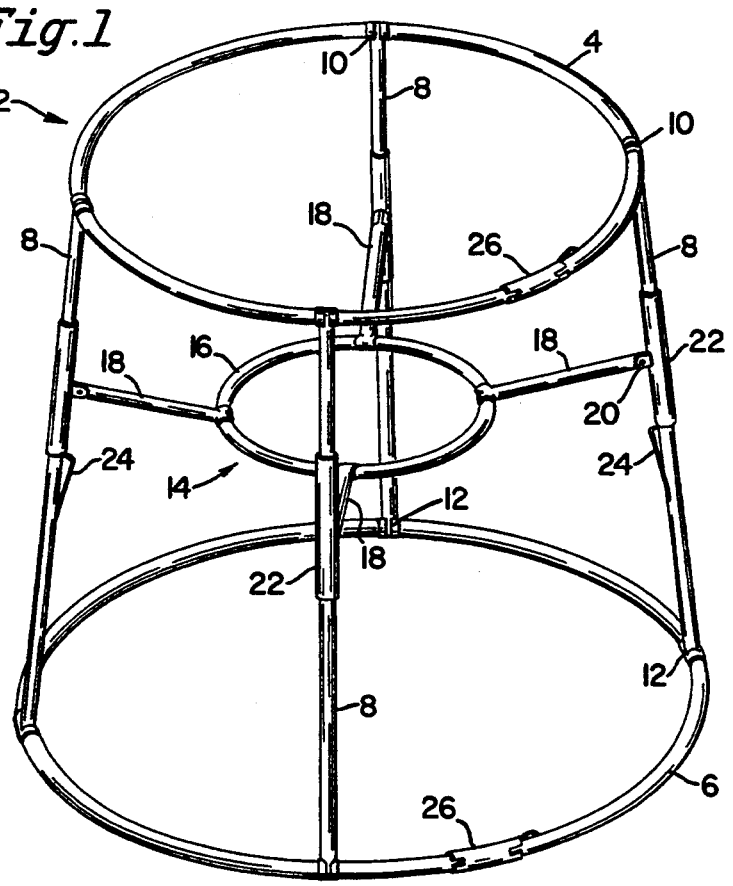

This invention relates to lampshades and in particular to a collapsible lampshade which can be shipped and stored in a substantially flat condition and which can be readily and quickly assembled by the consumer without the need for tools.

Generally, lampshades are manufactured in a preformed or assembled condition prior to being shipped to the consumer. As such, these lampshades require a considerable amount of storage and shipping space when compared to the weight of the component materials. This is particularly evident in the case of cylindrical or box shaped shades. While tapered or frusto-conical shaped lampshades may be nested or stacked, the resulting nest or stack still requires a considerable amount of space. Furthermore, assembled lampshades are invariably relatively fragile structures and are therefore subject to considerable wastage during the chain of distribution from manufacturer to consumer, for example, as a result of accidental breakage.

Modern merchandising practice requires that items such as lampshades be shipped or stored in individual packages for convenient delivery to the consumer. Preassembled lampshades cannot be cheaply stored or shipped in individual containers.

The present invention seeks to provide a collapsible lampshade which can be economically stored and shipped in a substantially flat condition but which can be readily and quickly assembled by the consumer without the need for tools.

According to the present invention there is provided a frame for a collapsible lampshade comprising upper and lower support members spaced in parallel planes; a plurality of peripherally spaced rib members extending between the support members, each rib member being pivotally mounted at one end to the upper support member and at the other end to the lower support member and having a hinge located intermediate said ends; and a spider member having a central hub and a plurality of radially extending struts, each strut being affixed at one-end to the hub, the other end being pivotally attached to a slide movably mounted on one of said rib members, the spider member being movable in a direction substantially perpendicular to said parallel planes which movement renders the frame from a braced condition in which movement of each rib member about its respective hinge is prevented to a collapsible condition in which each rib member is free to pivot about its respective hinge to collapse the frame.

The lampshades of the invention may be formed in a wide variety of configurations, e.g., cylindrical, box, tapered and frusto-conical shaped lampshades, with the assembled lampshade having substantially the same aesthetic appeal as a conventional factory assembled lampshade.

Broadly, the .lampshades of the invention comprise a collapsible frame defined by a pair of upper and lower support members and a plurality of peripherally spaced rib members extending therebetween, around which a shade cover comprising a suitable fabric, e.g., silk, is secured to complete the lampshade.

Each support member is typically formed as an endless member, commonly a ring, although substantially any shape, e.g., oval, elliptical and hexagonal, may be adopted depending on the desired configuration of the shade. The support member may also comprise an arrangement of struts, e.g., a box-shaped lampshade may be formed from two cross-shaped support members, with the rib members extending between the outer-most end of corresponding struts or alternatively, a cylindrical lampshade may be formed from two support members comprising a plurality of spokes radiating from a central hub, the rib members again extending between the outermost end of corresponding spokes. Both support members may be of equal size, thereby forming a cylindrical or box shaped lampshade, or of unequal size forming a frusto-conical or tapered lampshade.

The rib members extend between the support members and can be straight or bowed, either inwardly or outwardly, to enhance the aesthetic appeal of the shade. The rib members may be preformed in the desired configuration or alternatively the spider member may be formed with an oversize or an undersize when compared with the support members such that movement of the spider member may be used to distort the flexible rib members into the desired convex/concave arrangement. Generally, the lampshade comprises at least three, preferably at least four rib members, normally spaced equidistantly about the periphery of the support members to provide a sturdy frame for the shade cover. A greater number of rib members may be used, particularly when the support members are formed as more exotic shapes, e.g., ellipses, hexagons and octagons, to form lampshades of non-cylindrical or non-frustoconical shape. Commonly, eight rib members are used.

The ends of each rib member are pivotally mounted to the support members, to allow the two support members to be brought together when the lampshade is collapsed. However, for more complicated frames having curved or bowed rib members, it may be necessary to use a universal joint, thereby imparting a degree of rotational freedom to each rib member, to allow the support members to be brought together for packaging.

Each rib member is hinged to allow the lampshade to be erected or collapsed. The position of the hinges is dependent on the relative size of each support member, e.g., for a cylindrical lampshade comprising two ring shaped support members of equal diameter, the hinge would be located at the midpoint of the rib member. For a frusto-conical lampshade comprising two ring shaped support members of unequal size, the hinge would be located closer to the smaller member. The size of the support members will normally determine the actual position of the hinges.

The rib members may also comprise two or more hinges, with each hinge being associated with a separate spider member. In this manner, it is possible to produce larger and more complex lampshade shapes, e.g., a composite cylindrical/frusto-conical shade.

The lampshades of the invention are erected or collapsed as a result of the movement of each rib member about its respective hinge, e.g., by pivoting each rib member inwardly, or outwardly, about its respective hinge the two support members may be drawn together, thereby collapsing the lampshade. By reversing this movement, the two support members are drawn apart, thereby erecting the shade.

Generally, the spider member is slideably mounted about each rib member such that the act of displacing the spider member in a direction substantially perpendicular to the plane of each support member causes each rib member to pivot about its respective hinge. The spider member comprises a central hub and a plurality of radially extending struts, usually one strut per rib member. One end of each strut is affixed to the central hub with the other end being pivotally attached to a slide movably mounted about one of the rib members. The central hub typically comprises a ring shaped member which may be used to support the fully erect lampshade on the lamp holder. The slide generally comprises a sleeve extending either partially or completely around the rib or a shoe engaging a complementary channel or groove on the rib member. Preferably, one or more of the rib members comprises a latch mechanism which engages the slide to secure the spider member in position. For example, when the slide is formed as a sleeve, the latch mechanism may comprise a spring clip on the rib member allowing movement of the slide in only one direction until the clip is released. Preferably, provision is made for the latch mechanism of each rib member robe disengaged simultaneously to facilitate the collapse of the-lampshade. Such provision can take the form of a latch mechanism that operates in the same circumferential direction on all the rib members, and can be operated for example by a single twisting movement of the spider.

Generally, when the shade is to be erected, the user simply holds one of the support members and displaces the spider member in a direction substantially perpendicular to the plane of the support members causing the rib members to be extended either inwardly or outwardly about their respective hinges, thereby moving the support members away from each other and erecting the shade. Normally, the user would invert the shade while holding one of the support members uppermost thereby allowing the weight of the other support member to partially erect the shade. Shade erection is completed by the user resting the lower most support member on a firm surface, for example, a table and pushing downwards on the spider member to fully extend the rib members. When the rib members are fully extended the latch mechanism secures each slide and thus the spider member in position, thereby preventing the frame from collapsing until so desired by the user. This movement of the spider member may be resisted by spring mechanisms in the rib members either acting on the slides or the hinge mechanism itself.

The lampshade is typically mounted on the lampholder using the central hub of the spider member to engage the stem of the lampholder. However, it may in some cases be desirable to include a dedicated mounting assembly formed to lie in the same or in a different plane as either support member. For ease of packaging and material economy it is preferred that the mounting assembly lies in the same plane as the support member.

The lampshade is generally returned to the collapsed condition by reversing the above sequence of events, i.e., disengaging the latch mechanism and returning the spider member to its home position, either manually or under the action of gravity, thereby pivoting the rib members about their respective hinges to draw the support members together.

The lampshade frame is normally partially erected prior to fitting the shade cover to prevent entangling and creasing. In the final assembly steps, and as the slides move over the latch mechanisms, the cover is slightly stretched over the frame. The shade cover is desirably provided in a range of colours, patterns and trims to allow the user to change the shade cover to match a change in room decor. This is particularly advantageous for hoteliers etc., where periodic redecorating often necessitates disposal of old furnishings, including lampshade covers, in the previous colour scheme.

The present invention is directed at a collapsible lampshade comprising a collapsible frame and a shade cover. However, the two components will often be manufactured and sold separately, particularly when a number of covers are to be used on the same frame.

Figure 4:
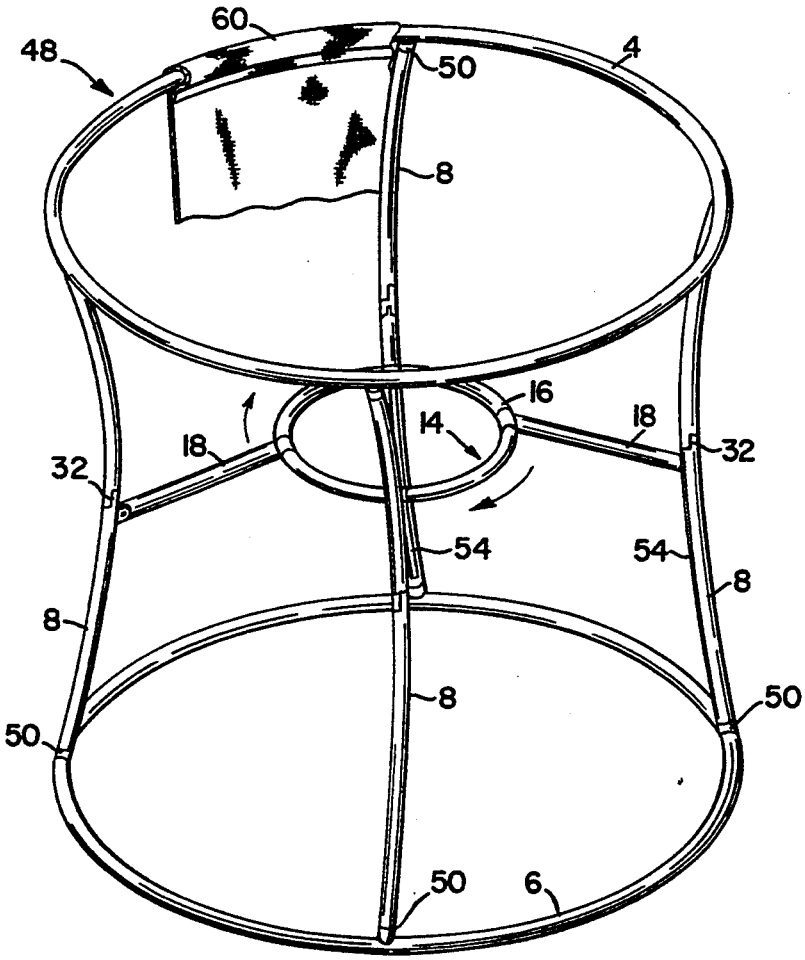
Figure 5:
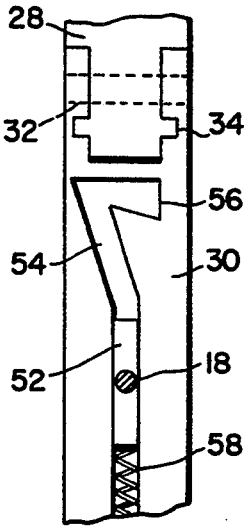

The invention will now be described by way of example and with reference to the accompanying drawings in which:

FIG. 1 is a perspective view of a collapsible frame for a lampshade in accordance with the invention;

FIGS. *2a* and *2b* represent an enlarged view of a portion of a rib member from the frame of FIG. 1 illustrating the hinge and latch mechanism;

FIGS. *3a* and *3b* represent an alternative hinge and latch mechanism suitable for use with the collapsible lampshade of the invention;

FIG. 4 is a perspective view of another collapsible frame for a lampshade in accordance with the invention; and FIG. 5 is an enlarged view of a portion of a rib member from the frame of FIG. 4 illustrating the hinge and latch mechanism.

Referring to FIG. 1, a collapsible frame (2) for a frusto-conical lampshade comprises an upper ring member (4), a lower ring member (6) and four equi-spaced rib members (8). Each rib member (8) is pivotally mounted at one end (10) to the upper ring member (4) and at the other end (12) to the lower ring member (6) and comprises a hinge (obscured by sleeve (22)—see FIGS. *2a* and *2b* for a more detailed explanation of the hinge mechanism).

Spider member (14) comprises a central hub (16) which is supported by a lamp stand and four equi-spaced struts (18). Each strut (18) is affixed at one end to the hub (16), the other end (20) being pivotally mounted to a sleeve (22) enclosing one of the rib members (8). Each sleeve (22) is engaged by a spring-biased clip (24) to secure the spider member (14) in position, thereby preventing the frame (2) from collapsing.

The frame (2) is collapsed by pushing each clip (24) into a complementary recess on the rib member (8) and pushing down on central hub (16) so that the sleeve (22) can bypass clip (24). Further movement of the spider member (14) causes each rib member (8) to bend inwardly about its respective hinge, thereby drawing the ring members (4 and 6) together to collapse the frame (2). The provision of pivot points at (10, 12 and 20) allows the frame (2) to be collapsed into a substantially flat condition for shipping and storage.

Each ring member (4 and 6) is advantageously provided with a reducing leg (26) to facilitate loading of the shade cover (not shown). Each reducing leg (4 and 6) which is pivotally coupled to enable the overall peripheral length of the member to be reduced to fit a cover thereto. It is normally spring-biased to the extended positions shown.

FIGS. *2a* and *2b* depict enlarged views of one of the-rib members from the collapsible frame shown in FIG. 1. FIG. *2a* is a view of the rib member with the the frame is fully erect.

The rib member (8) comprises an upper portion (28) and lower portion (30) pivotable about hinge (32). A stop (34) is provided on the upper portion (28) of the rib member which engages a complementary surface (36) on the lower portion (30) of the rib member to restrict its range of movement.

In order to erect the frame, spider member (14) is moved in a direction substantially perpendicular to the plane of the ring members, thereby causing sleeve (22) to move towards hinge (32) over clip (24) as indicated by the solid arrow in the Figure.

Figure 2A:
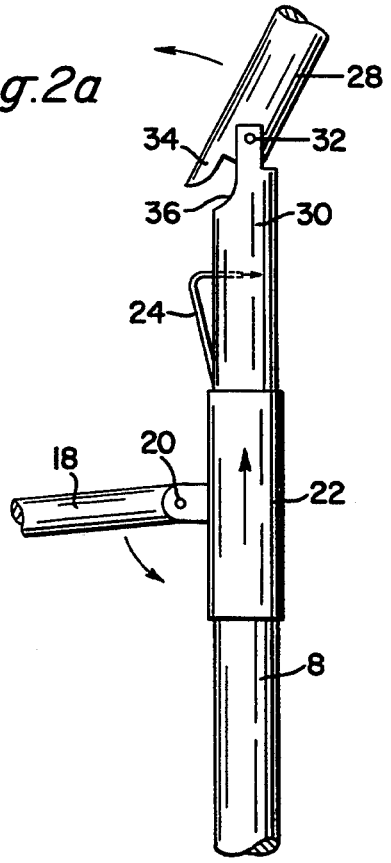
Figure 2B:
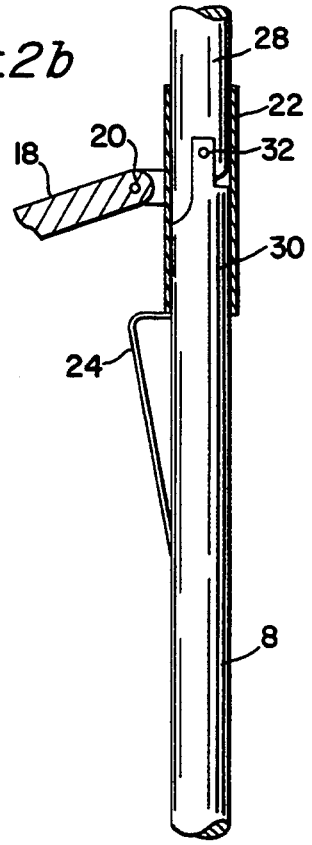

Referring to FIG. 2*b*, in the fully erect position, sleeve (22), shown in partial section, is positioned around the hinge (32), thereby reinforcing the frame. Clip (24) engages the sleeve (22) to secure the spider member in position.

Figure 3A:
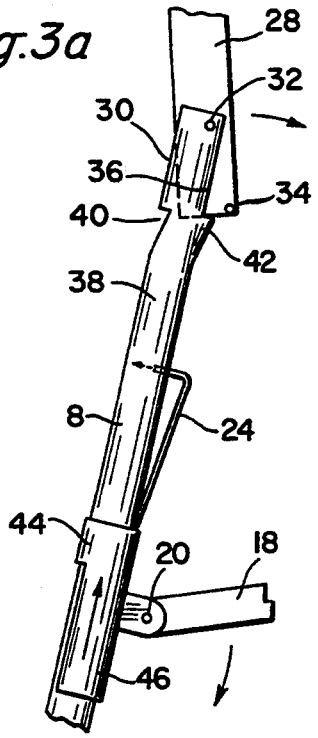
Figure 3B:
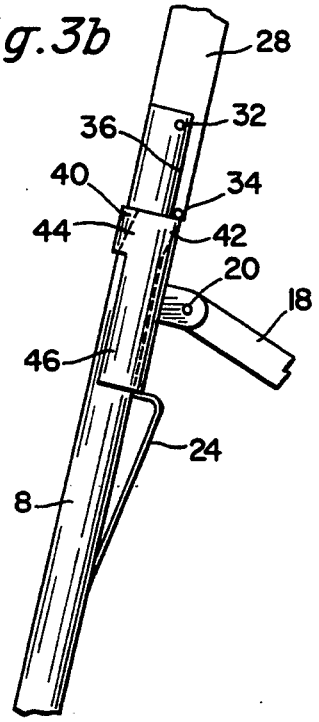

FIGS. 3*a* and 3*b* depict an alternative hinge mechanism for use in the collapsible lampshades of the invention. The basic configuration of the lampshade frame is the same as that described for FIG. 1 with the exception of the rib member and sleeve which are slightly altered to produce a smoother contour in the covered lampshade. The rib member (8) again comprises an upper portion (28) and a lower portion (30), the upper portion (28) having a stop (34) which abuts surface (36) on lower portion (30). However, the lower portion (30) of the rib member is distorted at (38) to define a cutaway (40) and a projection (42). The sleeve is formed with an upper portion (44) which encloses the rib member (8) and a lower portion (46) which only partially extends around the rib member (8). In this manner, when the frame (2) is fully erect, the sleeve can adopt the position shown in FIG. 2*b* with sleeve portion (44) completing cutaway (40) so that the hinge mechanism does not interfere with the line of the shade cover.

FIGS. 4 and 5 depict an alternative collapsible frame (48) embodying the invention. The basic arrangement of the frame (48) is broadly similar to that of the frame shown in FIG. 1. However, it can be seen that the rib members (8) are bowed inwards and the linkage between each rib member (8) and each ring member (4 and 6) comprises a universal joint (50) to allow the frame (48) to be stored in a substantially flat container.

Each strut (18) of spider member (14) is pivotally mounted to a shoe (52) which is secured in a complementary channel (54) running along the longitudinal axis of the lower portion (30) of each rib member.

When the shade is to be erected, the user simply holds the lower ring member (6) and displaces the spider member (14) as described previously sliding each shoe (52) along its respective groove (54) thereby causing the rib members (8) to extend outwardly about their respective hinges (32) and moving the ring members (4 and 6) away from each other in order to support a cover (60). When fully erect, the spider member (14) is secured in position by turning the central hub (in the direction of the bold arrows), such that each shoe (52) locates in slot (56), thereby preventing the frame from collapsing. The movement of the spider member (14) may be resisted by spring mechanisms (58) located within each channel (54) and acting on the shoes (52), or alternatively about hinge (32) to bias the frame (48) into the closed condition, thereby increasing the rigidity of the erected shade.

The frame (48) is collapsed by repeating the twisting movement but in the opposite direction to relocate the shoes (52) in channel (54) and returning the spider member ( 14 ) to its home position, thereby bending the rib members (8) inwardly about their respective hinges to collapse the frame.

I claim:

1. A frame for a collapsible lampshade comprising;

upper and lower support members spaced in parallel planes;

a plurality of peripherally spaced rib members extending between the support members, each rib member being pivotally mounted at one end to the upper support member and at another end to the lower support member and having a hinge located intermediate said ends, and a spider member having a central hub and a plurality of radially extending struts, each strut being affixed at one end to the hub, and at another end being pivotally attached to a slide movably mounted on one of said rib members, the spider member being movable in a direction substantially perpendicular to said parallel planes, which movement renders the frame from a braced condition, in which movement of each rib member about its respective hinge is prevented, to a collapsible condition, in which each rib member is free to pivot about its respective hinge to collapse the frame.

2. A frame for a collapsible lampshade as claimed in claim 1 in which each support member comprises an endless member.

3. A frame for a collapsible lampshade as claimed in claim 1 in which each slide comprises a sleeve extending at least partially around its rib member.

4. A frame for a collapsible lampshade as claimed in claim 3 in which the rib member includes a cutaway portion of complementary shape to a portion of the sleeve and arranged such that when the frame is in the braced condition said sleeve portion lies in and completes the cutaway portion to provide a smooth contour when the rib member is covered.

5. A frame for a collapsible lampshade as claimed in claim 1 in which at least one rib member comprises a latch mechanism which engages the slide to secure the spider member and frame in the braced condition.

6. A frame for a collapsible lampshade as claimed in claim 5 further comprising means to simultaneously disengage each latch mechanism to facilitate the collapse of the frame.

7. A frame for a collapsible lampshade as claimed in claim 5 further comprising means to bias the frame into the collapsed position.

8. A frame for a collapsible lampshade as claimed in claim 1 comprising at least four rib members spaced equidistantly about the periphery of the support members.

9. A frame for a collapsible lampshade as claimed in claim 1 in which each rib member comprises an upper portion pivotally mounted at one end to the upper support member and a lower portion pivotally mounted at one end to the lower support member, another end of each portion completing said hinge which allows for pivotal movement of the two portions thereabout to collapse the frame.

10. A frame for a collapsible lampshade as claimed in claim 9 in which one of said portions is provided with a stop which when the frame is in the braced conditions abuts a complementary surface on another of said portions to prevent further pivotal movement therebetween.

11. A frame for a collapsible lampshade as claimed in claim 1 in which each of said rib members comprises a groove formed therein and each slide comprises a shoe that engages a complementary groove formed in one of said members.

12. The frame for a collapsible lampshade as claimed in claim 1 further comprising a shadecover.

* * * * *